US005873615A

United States Patent [19]

McCullough

[11] Patent Number: 5,873,615

[45] Date of Patent: Feb. 23, 1999

[54] GRAPPLE

[76] Inventor: Byron McCullough, Box 1872, Swan River, Canada

[21] Appl. No.: 986,827

[22] Filed: Dec. 8, 1997

[51] Int. Cl.[6] ..... B66C 1/30

[52] U.S. Cl. ..... 294/106; 294/3; 294/86.4; 294/119.1; 414/731

[58] Field of Search ..... 294/2, 3, 67.31, 294/67.23, 81.51, 81.54, 81.62, 86.4, 88, 106, 119.1; 414/731, 732, 736, 741

[56] References Cited

U.S. PATENT DOCUMENTS

| | | | |
|---|---|---|---|
| 2,646,305 | 7/1953 | Sonderstrup | 294/67.31 |
| 3,439,818 | 4/1969 | O'Neil | 294/106 |
| 4,212,577 | 7/1980 | Swanson | 414/731 |
| 5,219,265 | 6/1993 | Recker | 414/731 |

*Primary Examiner*—Dean Kramer
*Attorney, Agent, or Firm*—Adrian D. Battison; Murray E. Thrift

[57] ABSTRACT

A grapple including a central mounting member for attachment to a swivel mount of a boom and a pair of grapple jaws pivotally connected to and depending from the mounting member is modified by the addition of a pair of end engagement plates for engaging and locating ends of the logs when grasped for lifting, the plates defining inwardly facing parallel surfaces arranged substantially at right angles to the axes. The end engagement plates are mounted on a pair of horizontal slide beams for inward and outward movement and are attached by sleeves sliding on vertical rails of the plates for movement vertically relative to the central mounting member.

11 Claims, 3 Drawing Sheets

GRAPPLE

The present invention relates to a grapple for lifting logs or similar materials which includes a pair of squeeze plates for locating the ends of the logs.

BACKGROUND OF THE INVENTION

Grapples for lifting logs and similar elements are well known and generally comprise a boom mounted on a suitable transportation vehicle with a swivel coupling at the end of the boom which carries a mounting head for swivelling movement around a vertical axis at the end of the boom. On the mounting head is carried a pair of upstanding parallel plates each on a respective side of the swivel and between the plates is a pair of grapple jaws with each jaw having a pivot mounting at its upper inner end. The jaws are driven by suitable hydraulic mechanisms so that depending outer end can be moved inwardly and outwardly to engage around a collection of logs or other equipment to be lifted.

The grapple is often used in logging for lifting logs onto a trailer for transportation and generally the logs are of the same or similar length with the intention that they be loaded in parallel arrangement with the ends at the sides of the trailer.

Various techniques are used for locating the ends so that they are substantially coplanar standing in vertical planes at the side of the vehicle. Some logs are difficult to load in this way and that they are particularly slippery and tend to twist within the grapple jaws and poplar is one example of logs which are difficult to load in this way.

SUMMARY OF THE INVENTION

It is one object of the present invention to provide an improved grapple for lifting logs which allows better control of the logs while they are being lifted and particularly slippery logs such as poplar which can be difficult to control.

According to a first aspect of the invention, therefore, there is provided a grapple comprising:

- a central mounting member for attachment to a swivel mount of a boom;
- a pair of grapple jaws pivotally connected to and depending from the mounting member, each for pivotal movement about a respective one of a pair of parallel generally horizontal pivot axes such that the jaws can move from an open position toward each other into a closed position for grasping a plurality of logs for lifting;
- and a pair of end engagement plates for engaging and locating ends of the logs when grasped for lifting, the plates defining inwardly facing parallel surfaces arranged substantially at right angles to the axes;
- the end engagement plates being mounted on the mounting member for movement relative to the mounting member in a direction at right angles to the surfaces so as to decrease the distance between the surfaces for squeezing the log ends.

Preferably the end engagement plates are mounted for movement vertically relative to the central mounting member.

Preferably the end engagement plates are mounted for free independent sliding movement in the vertical direction.

Preferably the mounting member includes a pair of horizontal parallel mounting beams located each on a respective side of the swivel head and parallel to the pivot axes each of the end engagement plates being mounted at a respective end of the mounting beams.

Preferably the mounting beams includes a pair of slide portions for movement longitudinally thereof.

Preferably each slide portion has a sleeve at an end thereof at right angles to the beam and receiving a vertical rail of the end engagement member for sliding movement therealong.

Preferably the vertical rail is mounted at a position on the end engagement plate spaced inwardly of the sides thereof.

Preferably the vertical rail is mounted on the end engagement plate between top and bottom horizontal rails thereof.

Preferably the mounting beams are welded to a pair of grapple mounting plates at right angle to the beams, each grapple mounting plate being located on a respective side of the grapple jaws and carrying the grapple jaws therebetween for said pivotal movement relative thereto.

Preferably the grapple mounting plates extend above the mounting beams with the beams passing therethrough.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
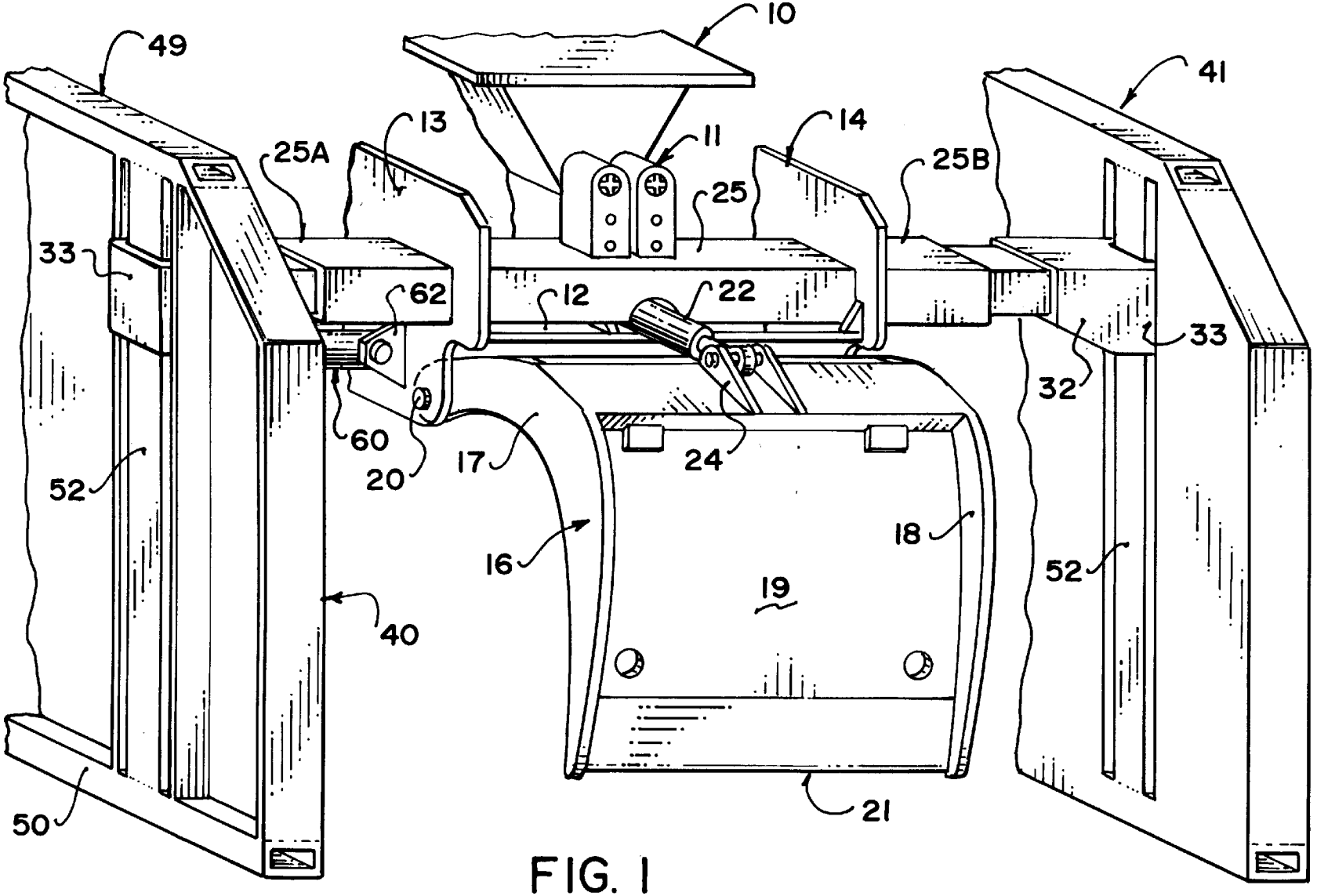
FIG. 1 is an isometric view of one half only of a grapple according to the present invention.
Figure 2:
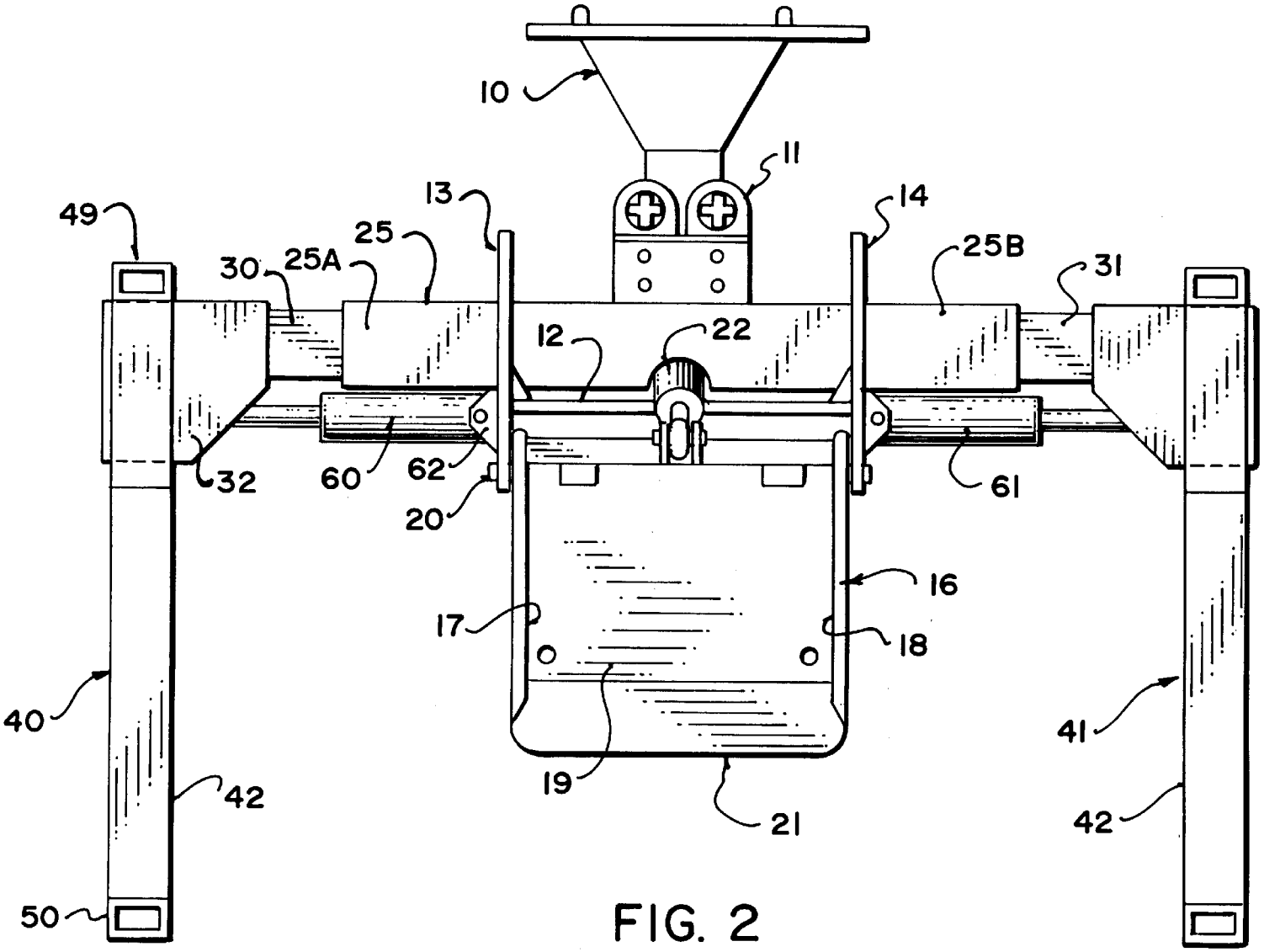
FIG. 2 is a side elevational view of the grapple of FIG. 1.
Figure 3:
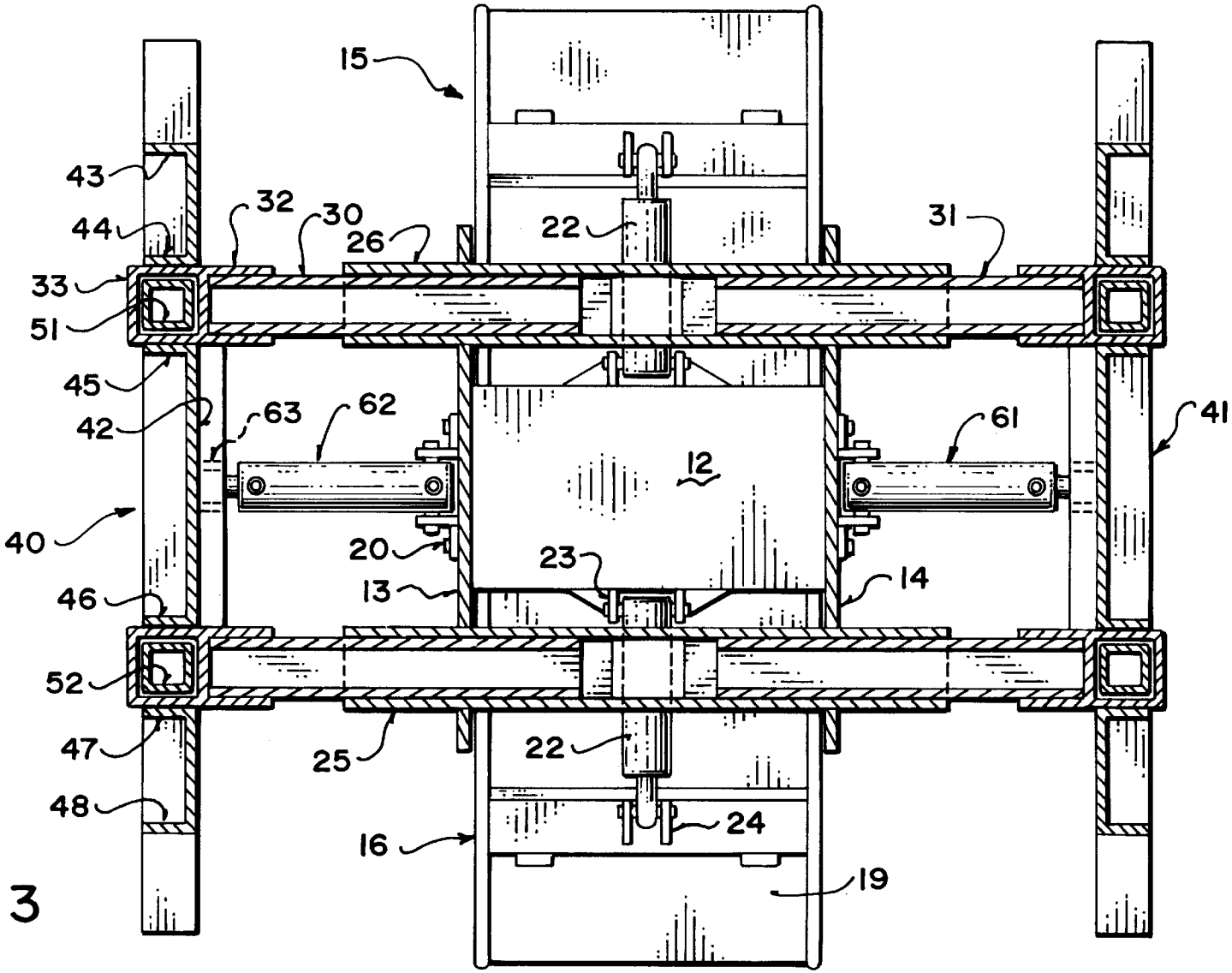
FIG. 3 is a top plan view of the grapple of FIG. 1 with the swivel mounting omitted for convenience of illustration.

A grapple includes a swivel mounting generally indicated at 10 which is arranged for attachment to a boom (not shown) of a suitable transportation vehicle. The swivel mounting includes a pair of drive motors 11 which operate twisting movement of the swivel so that a support plate 12 of a mounting member of the grapple can twist relative to the boom about a vertical axis to effect adjustment of the orientation of the grapple jaws of the grapple. The mounting plate 12 is attached to a pair of upstanding parallel grapple plates 13 and 14 which are arranged each on a respective side of the swivel 10.

The grapple jaws are indicated at 15 and 16 respectively and each comprises a pair of arcuate side plates 17 and 18 and a transverse jaw plate 19. At the upper inner end, each side plate 17, 18 is arranged to lie just inside and parallel to a respective one of the grapple plates 13 and 14. A pivot pin 20 provides a pivotal movement of the grapple jaw about a pivot axis passing through the aligned pivot pins 20 with an axis being at right angles to the grapple plates 13 and 14. The side plates 17 and 18 and the grapple plate 19 converge to an apex 21 which depends downwardly from the pivot pin 20 and that apex defines in effect an edge of the grapple jaw with the apexes of the two grapple jaws moved inwardly and outwardly by the pivotal movement around the pivot axes of the grapple jaws. Actuation of the movement of the grapple jaws is effected by a pair of cylinders 22 which extend from a bracket 23 on a side of the mounting plate 12 to a bracket 24 on the back of the grapple plate 19.

A pair of mounting beams 25 and 26 extend through an upper part of the grapple plates 13 and 14 at right angles thereto and are welded to the grapple plates so as to be fixed in position thereon. Each beam 25 therefore has a respective end 25A, 25B extending outwardly beyond an outer side of the respective grapple plate 13, 14. At each end of the beam 25, 26 are provided a slide portion 30, 31 which can slide inwardly and outwardly inside the beam with an outside surface of the slide portion forming a sliding fit on the interior of the beam. At each outer end of the slide portion 30, 31 is provided a bracket 32 defining a vertical sleeve 33. Thus the two beams provide four vertical sleeves arranged in pairs with each pair on a respective side of the grapple plates. The beams carry a pair of end engagement plates 40 and 41 each mounted respectively on a pair of the sleeves 33. Each engagement plate comprises an inner sheet metal plate 42 which is supported by a plurality of flanges 43, 44, 45, 46, 47 and 48 at spaced positions across the plate so as to provide a rigid structure for the plate. The flanges are welded to a top rail 49 and a bottom rail 50 also attached to the sheet metal plate 42. The plate 42 thus defines an inwardly facing surface for engaging the ends of the logs.

Between the flanges 44 and 45 and between the flanges 46 and 47 is welded a vertical rail 51, 52 which is shaped to fit inside a respective one of the sleeves 33. The rail 51, 52 is free and exposed between the top and bottom rails 49 and 50 and therefore the sleeve can slide upwardly and downwardly relative to the rail along the full length of the rail.

Each engagement plate 40, 41 is therefore free to slide vertically upwardly and downwardly relative to the beams. No power is provided for this sliding movement but instead the plate is free to slide upwardly and downwardly if engaged at the bottom and pushed upwardly. Inward and outward driving movement of the slide portions 30 and 31 is effected by a pair of drive cylinders 60 and 61 connected between brackets 62 on the respective grapple plate and 63 on the engagement plate.

The grapple plates 13 and 14 are arranged so that they are increased in width and thus extend outwardly to the sides of the pivot pins 20 in load portions above the pivot pins 20 with a top surface of the grapple plate arranged above the beams. The grapple plate therefore forms a relatively wide upper portion sufficient to receive the beams therethrough with the beams being spaced sufficiently to allow the position of the swivel mount 10 between the beams.

In use, the cylinders 60 and 61 are actuated to move the engagement plates to a fully extended position spaced outwardly from the grapple jaws. The boom is then actuated to move the grapple to a position for lifting a plurality of logs with the logs extending parallel to the pivot axes of the grapple jaws. The grapple jaws are then actuated to move inwardly to grasp the logs. As the grapple jaws are moved to the required position, in the event that the bottom rails 50 engage the ground or other element in the area, the engagement plate is thus pushed upwardly so it slides along the sleeves 33 to whatever position it reaches when pushed by the downward movement of the grapple. The engagement plates 40 and 41 are then moved inwardly by actuation of the cylinder 60 and 61 so that the inside surface of the plate 42 engages the ends of the logs to push the logs into a coextensive position and to assist in supporting the logs by holding the ends. The logs are thus prevented from slipping and twisting and moving longitudinally so that all of the logs are held in position for effective transportation by the grapple to a suitable location such as a loading trailer.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A grapple comprising:

a central mounting member for attachment to a swivel mount of a boom;

a pair of grapple jaws pivotally connected to and depending from the mounting member, each for pivotal movement about a respective one of a pair of parallel generally horizontal pivot axes such that the jaws can move from an open position toward each other into a closed position for grasping a plurality of logs for lifting;

and a pair of end engagement plates for engaging and locating ends of the logs when grasped for lifting, the plates defining inwardly facing parallel surfaces arranged substantially at right angles to the axes;

the mounting member including a pair of horizontal parallel mounting beams located each on a respective side of the swivel mount and parallel to the pivot axes;

the end engagement plates being mounted on the mounting member at a respective end of the mounting beams for movement relative to the mounting member in a direction at right angles to the surfaces so as to decrease the distance between the surfaces for squeezing the log ends.

2. The grapple according to claim 1 wherein the end engagement plates are mounted for movement vertically relative to the mounting beams in a direction at right angles to the beams.

3. The grapple according to claim 2 wherein the end engagement plates are mounted on the mounting beams for free independent sliding movement in the vertical direction.

4. The grapple according to claim 1 wherein each mounting beam includes a pair of slide portions for movement longitudinally thereof for moving the end engagement plates at right angles to the surfaces.

5. The grapple according to claim 4 wherein each slide portion has a sleeve at an end thereof at right angles to the beam and receiving a vertical rail of the end engagement plate for sliding movement therealong in a direction at right angles to the beams.

6. The grapple according to claim 5 wherein the vertical rail is mounted at a position on the end engagement plate spaced inwardly from the sides thereof.

7. The grapple according to claim 5 wherein the vertical rail is mounted on the respective end engagement plate between top and bottom horizontal rails thereof.

8. The grapple according to claim 1 wherein the mounting beams are welded to a pair of grapple mounting plates at right angle to the beams, each grapple mounting plate being located on a respective side of the grapple jaws and carrying the grapple jaws therebetween for said pivotal movement relative thereto.

9. The grapple according to claim 8 wherein the grapple mounting plates extend above the mounting beams with the beams passing therethrough.

10. A grapple comprising:

a central mounting member for attachment to a swivel mount of a boom;

a pair of grapple jaws pivotally connected to and depending from the mounting member, each for pivotal movement about a respective one of a pair of parallel generally horizontal pivot axes such that the jaws can move from an open position toward each other into a closed position for grasping a plurality of logs for lifting;

and a pair of substantially vertical end engagement plates for engaging and locating ends of the logs when grasped for lifting, the plates defining inwardly facing parallel surfaces arranged substantially at right angles to the axes;

the mounting member including a rigid support structure for supporting the end engagement plates;

the rigid support structure being actuable for effecting substantially horizontal movement of the end engagement plates relative to the mounting member inwardly and outwardly in a direction at right angles to the surfaces so as to decrease and increase the distance between the surfaces for squeezing and releasing the log ends;

the rigid support structure supporting the end engagement plates for guided movement in a substantially vertical direction parallel to the surfaces.

11. The grapple according to claim 10 wherein the end engagement plates are mounted on the rigid support structure for free independent sliding movement in the vertical direction.

* * * * *